US009845138B2

(12) United States Patent
Köhnsen

(10) Patent No.: US 9,845,138 B2
(45) Date of Patent: Dec. 19, 2017

(54) WATER SPORT DEVICE HAVING A FIN

(71) Applicant: SASHAY GMBH, Hamburg (DE)

(72) Inventor: Benjamin Köhnsen, Scharbeutz (DE)

(73) Assignee: Sophia Verwaltungs GmbH, Rastatt (DE)

( * ) Notice: Subject to any disclaimer, the term of this patent is extended or adjusted under 35 U.S.C. 154(b) by 0 days.

(21) Appl. No.: 14/916,595

(22) PCT Filed: Sep. 2, 2014

(86) PCT No.: PCT/DE2014/100314
§ 371 (c)(1),
(2) Date: Mar. 4, 2016

(87) PCT Pub. No.: WO2015/032387
PCT Pub. Date: Mar. 12, 2015

(65) Prior Publication Data

US 2016/0207601 A1 Jul. 21, 2016

(30) Foreign Application Priority Data

Sep. 4, 2013 (DE) ..... 20 2013 103 977 U

(51) Int. Cl.

| | |
|---|---|
| ***B63H 11/117*** | (2006.01) |
| ***B63H 11/113*** | (2006.01) |
| ***B63B 35/79*** | (2006.01) |
| ***B63H 21/17*** | (2006.01) |

(52) U.S. Cl.
CPC ..... *B63H 11/113* (2013.01); *B63B 35/7926* (2013.01); *B63B 35/7943* (2013.01); *B63H 21/17* (2013.01)

(58) Field of Classification Search
CPC ..... B63H 11/00; B63H 11/02; B63H 11/10; B63H 11/101; B63H 11/102; B63H 11/103; B63H 11/107; B63H 11/113; B63H 11/117; B63H 2011/00; B63H 2011/02; B63H 2011/04; B63H 2011/043; B63H 2011/08; B63H 2011/081; B63B 35/7926; B63B 35/7943
USPC ..... 440/38, 40, 42, 43; 441/74, 79
See application file for complete search history.

(56) References Cited

U.S. PATENT DOCUMENTS

| | | | | |
|---|---|---|---|---|
| 3,143,996 | A * | 8/1964 | Chapman | B63B 1/20 114/281 |
| 3,150,632 | A * | 9/1964 | Evans | B63B 35/731 114/123 |
| 3,313,265 | A * | 4/1967 | Guin | B63B 35/7943 440/23 |
| 3,340,845 | A * | 9/1967 | Tyrack | B63B 35/7943 114/55.56 |
| 5,582,529 | A * | 12/1996 | Montgomery | B63B 35/731 441/74 |
| 6,192,817 | B1 * | 2/2001 | Dec | B63B 35/7943 114/55.56 |
| 7,410,400 | B2 * | 8/2008 | Staudinger | B63B 1/14 114/123 |

(Continued)

*Primary Examiner* — Daniel V Venne
(74) *Attorney, Agent, or Firm* — Bay State IP, LLC

(57) ABSTRACT

The invention relates to a water sport device having a sitting or standing surface (2) for a person practicing water sports, a jet drive (8) and a pivotable nozzle (13), wherein a fin (23) is disposed at the nozzle (13) and is arranged in a fixed position relative to said nozzle.

4 Claims, 1 Drawing Sheet

(56) References Cited

U.S. PATENT DOCUMENTS

| | | | | |
|---|---|---|---|---|
| 2003/0176120 | A1 | 9/2003 | Walkowiak | |
| 2013/0323989 | A1 * | 12/2013 | Derrah | B63H 21/17 440/6 |

* cited by examiner

WATER SPORT DEVICE HAVING A FIN

CROSS REFERENCE TO RELATED APPLICATION

This application is for entry into the U.S. National Phase under §371 for International Application No. PCT/DE2014/100314 having an international filing date of Sep. 2, 2014, and from which priority is claimed under all applicable sections of Title of the United States Code including, but not limited to, Sections 120, 363, and 365(c), and which in turn claims priority under 35 USC 119 to German Patent Application No. 20 2013 103 977.2 filed on Sep. 4, 2013.

BACKGROUND OF THE INVENTION

Field of the Invention

The invention relates to a water sport device having a sitting or standing surface for a person practising water sports, a jet drive and a pivotable nozzle.

Description of the Related Art

Water sport devices having a jet drive and a pivotable nozzle in the form of jet skis or surfboards are known, the latter for example from DE 20 2011 051 071. The controllable surfboard shown in the last-mentioned utility model document has a surfboard that has a jet drive integrated therein. The jet drive is provided with a pivotable nozzle for water sucked in at an underwater surface of the surfboard. By pivoting the nozzle, the surfboard can be manoeuvred to go around a right-hand or a left-hand bend. The control of the nozzle can be carried out via a controller held in the hand of the person practising water sports or by means of a gyro sensor provided in the surfboard. In the latter case, the forward feed is controlled by means of a manual controller.

What is of disadvantage in the known water sport device is the fact that whilst bending, control is no longer possible if the forward feed of the jet drive is too low or is switched off. In this case, the water sport device will then only carry out a lateral drifting movement.

SUMMARY OF THE INVENTION

It is therefore the object of the present invention to provide a water sport device of the type mentioned in the beginning that allows improved cornering.

The object is achieved by means of a water sport device mentioned in the beginning having the characterising features of claim 1.

The invention utilises the idea of providing, in addition to the jet drive that during operation allows cornering by pivoting the nozzle, a pivotable fin that allows cornering even if the jet drive is not in operation or is not sufficiently strongly in operation and no water is sprayed out of the nozzle of the jet drive.

Advantageously, an axis of rotation is provided, about which the nozzle is arranged to be pivotable and about which the fin is also arranged to be pivotable. The fin and the nozzle are advantageously connected to each other so as to be fixed relative to each other, and a pivoting unit of the nozzle is also the pivoting unit of the fin. During operation, the fin is submerged in the water. Even if no propulsion by the nozzle takes place, the fin submerged in the water can still be used to steer the water sport device.

In a preferred embodiment of the invention, a standing or sitting surface for a person practising water sports is provided, and the axis of rotation is disposed to be perpendicular to the standing or sitting surface. A sitting or standing surface is here generally to be understood to be a unit on which a person practising water sports stands while practising the sport.

The invention relates to water sport devices in general having a jet drive. This may be understood to mean surfboards that have a jet drive integrated therein, but also conventional jet skis having a jet drive.

In a further preferred embodiment of the invention, the fin has a rear control surface that is provided behind the axis of rotation in the direction of movement of the water sport device and a front control surface that is mounted in front of the axis of rotation in the direction of movement. Together, the two control surfaces form the control surface of the fin. As a result of the fact that the axis of rotation does not extend along outer edges or completely outside of the control surface, but is passed through the control surface of the fin at an inward distance from the outer edges of the fin, the control surfaces each have a torque applied to them that cancel each other out when the fin is turned crosswise, so that the force acting on the pivot control of the fin and the nozzle is minimised.

Advantageously, the fin is fixed to a water side of the nozzle by means of nylon screws. On the one hand, the fin is fixed directly to the axis of rotation by means of a nylon screw and on the other hand it is fixed directly to the water side of the nozzle using a further nylon screw. Nylon screws can be obtained at low cost and can, even if they should break, be quickly and easily replaced. The nylon screws are designed as it were as predetermined breaking points of the fin, so that even if the water sport device is pulled across sand with its underwater surface or moves in very shallow waters and the fin should break, the fin itself is not damaged but breaks off from the nozzle at the two nylon screws which can be replaced at low cost.

The invention will be described by means of an embodiment example in three figures, wherein:

DETAILED DESCRIPTION OF THE PREFERRED EMBODIMENTS

The invention will be described by means of the surfboard 1, however it is not limited to a surfboard. It is also conceivable to transfer the invention to other water sport devices, in particular to jet skis.

Figure 1:
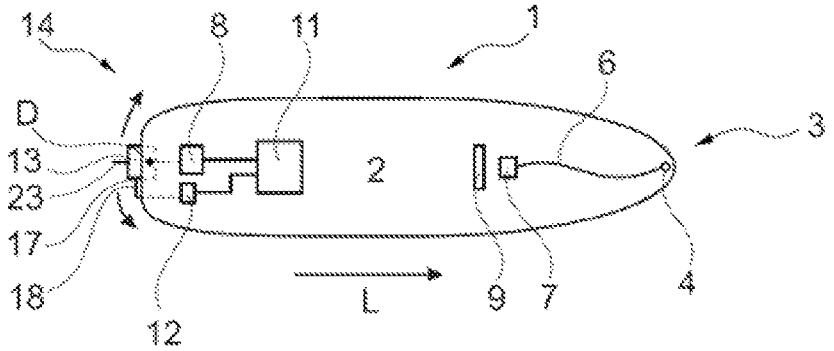
FIG. 1 shows a top view of a surfboard according to the invention.

In FIG. 1, the surfboard 1 according to the invention is shown with a standing surface 2 for a person practising water sports, which surface is horizontally orientated during operation. On a nose 3 of the surfboard 1, which in FIG. 1 is on the right-hand side, an eyelet 4 for a leash 6 is provided. One end of the leash 6 is tied in a knot to the eyelet 4. On another end of the leash 6, a controller 7 is tied in a knot. The controller 7 comprises a wireless radio link or a Bowden cable or a connection with a cable to a drive 8 integrated in the surfboard. The radio link is indicated by the dotted line. Further, a foot strap 9 is fastened to the standing surface 2 of the surfboard 1. For practising the sport, a person practising water sports can insert their foot into the foot strap 9 and can grasp and hold the controller 7 with one hand and can get additional hold on the surfboard 1 by the leash 6. In this case, the controller 7 is merely used for controlling the force of the propulsion of the surfboard, i.e. the speed of the surfboard 1. The controller may have a gyroscope function, so that the propulsion is modified via a tilting movement, or is implemented as a lever, a type of joystick.

A gyro sensor 11 is provided in the surfboard, which registers tilting movements about a longitudinal direction L of the surfboard 1. The gyro sensor 11 is linked to a pivoting device 12, 17, 18 that acts on the nozzle 13 mounted in the tail 14 and pivots the nozzle 13 in a plane that is parallel to the standing surface 2.

The pivot drive comprises an arm 17 provided on the nozzle 13, which has an actuator rod 18 articulated thereto. The actuator rod 18 is linked to a servomotor 12. The servomotor 12 allows the actuator rod 18 to be extended and retracted, so that a pivoting movement of the nozzle 13 can be carried out via the arm 17 in the plane of the drawing in FIG. 1.

Figure 2:
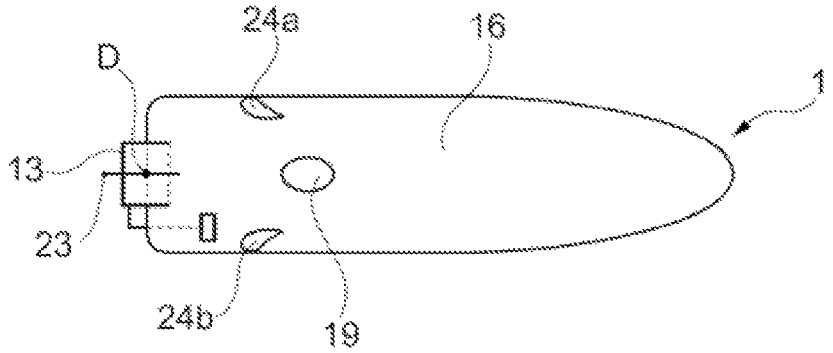
FIG. 2 shows a bottom view of the surfboard in FIG. 1.

FIG. 2 shows the surfboard 1 in FIG. 1 in a view from the bottom. In FIG. 2, an underwater surface 16 of the surfboard 1 is shown. The underwater surface 16 has an inlet 19 for the water. For generating propulsion, according to FIG. 3 water is sucked to the underwater surface 16 of the surfboard 1 and is accelerated by means of a propeller 21 and is ejected from the nozzle 13. Depending on which position the nozzle 13 has been pivoted to, the surfboard 1 can negotiate a right-hand or a left-hand bend.

Figure 3:
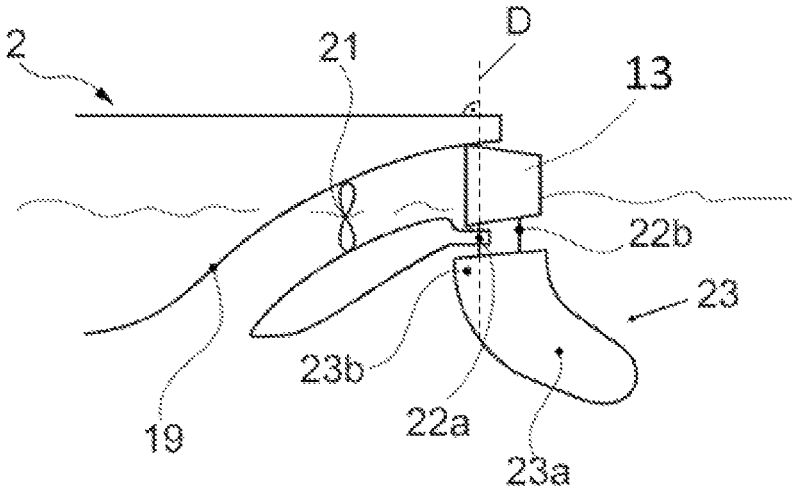
FIG. 3 shows a sectional view of the rear of the surfboard in FIGS. 1 and 2.

FIG. 3 shows the tail 4 of the surfboard 1 in FIGS. 1 and 2 in a sectional view. During operation, water is sucked in through the inlet 19 on the underwater surface 16, is accelerated by the propeller 21 provided in a water channel between the inlet 19 and the nozzle 13 and is pushed out of the nozzle 13. The propulsion of the surfboard 1 consists of the repulsion generated as a result of the ejection. The nozzle 13 is mounted to be pivotable about the axis of rotation D on the tail 14 of the surfboard 1 and terminates the water channel on the tail side. On the water side of the nozzle 13, a fin 23 is fixed to the nozzle 13. The fin 23 can be pivoted with the nozzle 13. The fin 23 is on the one hand screwed onto the axis of rotation D of the nozzle 13 by means of a nylon screw 22*a*, and on the other hand it is screwed to a water side of the nozzle 13 at a further point using a further nylon screw 22*b*. The axis of rotation D is perpendicularly oriented to the standing surface 2.

The fin 23 carries out the pivoting movement of the nozzle 13 about the same axis of rotation D as the nozzle 13. The nozzle 13 has a rear control surface 23*a* provided behind the axis of rotation D in the direction of movement of the surfboard 1 and a front control surface 23*b* provided in front of the axis of rotation D in the direction of movement. The two control surfaces 23*a*, 23*b* form the entire control surface of the fin 23. When the fin 23 is positioned at an angle in the water whilst cornering, a force is thus applied both onto the rear 23*a* and the front 23*b* control surfaces, and the torques on the axis of rotation D that form as a result substantially completely cancel each other out. As a result, the servo motor 12 carrying out the pivoting movement needs to exert less force in order to carry out the pivoting movement.

The fin 23 allows controlled cornering, even if the jet drive does not generate any propulsion, i.e. if no water is sprayed out of the nozzle 13.

According to FIG. 2, the fin 23 is supported by two further fins 24*a*, 24*b* which additionally stabilise the movement of the surfboard 1 and, due to their outwardly bent shape, generate additional propulsion.

LIST OF REFERENCE NUMERALS

1 Surfboard
2 Standing surface
3 Nose
4 Eyelet
6 Leash
7 Controller
8 Drive
9 Foot strap
11 Gyro sensor
12 Pivoting unit servomotor
13 Nozzle
14 Tail
16 Underwater surface
17 Arm of the pivoting unit
18 Actuating rod of the pivoting unit
19 Inlet
21 Propeller
22*a* Nylon screw
22*b* Further nylon screw
23 Fin
23*a* Rear control surface
23*b* Front control surface
24*a* Further fin
24*b* Further fin
L Longitudinal direction
D Rotary axis

What is claimed is:

1. A surfboard, comprising:

a sitting or standing surface (2) for a person practicing water sports, a jet drive (8), a pivotable nozzle (13), wherein a fin (23) is provided on the pivotable nozzle (13) and is mounted in a fixed position relative to the pivotable nozzle (13) and by an inlet (19) in an underwater surface (16) of the surfboard and wherein water is sucked in through the inlet (19) and is accelerated by a propeller (21) provided in a water channel between the inlet (19) and the nozzle (13) and is pushed out of the pivotable nozzle (13); and wherein the fin (23) has a rear control surface (23*a*) located behind the axis of rotation (D) of the nozzle (13) in a direction of movement of the surfboard and a front control surface (23*b*) provided in front of an axis of rotation (D) of the nozzle (13) in the direction of movement.

2. The surfboard according to claim 1, wherein the nozzle (13) the fin (23) are mounted to pivot around an axis of rotation (D).

3. The surfboard according to claim 1, wherein the sitting or standing surface (2) for a person practicing water sports and in that the axis of rotation (D) perpendicularly oriented to the sitting or standing surface (2).

4. The surfboard according to claim 1, wherein the fin (23) is fixed to a water side of the nozzle (13) by nylon screws (22*a*, 22*b*).

* * * * *